US008267099B2

(12) United States Patent
Cho

(10) Patent No.: US 8,267,099 B2
(45) Date of Patent: Sep. 18, 2012

(54) HEATED EYELASH GROOMER

(76) Inventor: Yong Hoon Cho, Fullerton, CA (US)

( * ) Notice: Subject to any disclaimer, the term of this patent is extended or adjusted under 35 U.S.C. 154(b) by 217 days.

(21) Appl. No.: 12/657,960

(22) Filed: Jan. 29, 2010

(65) Prior Publication Data

US 2011/0186072 A1 Aug. 4, 2011

(51) Int. Cl.
*A45D 2/48* (2006.01)
*A45D 1/04* (2006.01)

(52) U.S. Cl. ..... 132/217; 219/222

(58) Field of Classification Search ..... 132/217, 132/213.1, 216, 218, 219, 118, 119.1, 147, 132/148, 223, 229, 233, 269, 271, 297, 317, 132/318, 320, 286; 206/581, 823; 219/221, 219/222, 223; 401/9, 10, 207, 196, 261, 401/129, 128, 130; 15/207.2, 22.1; 220/4.26, 220/4.27

See application file for complete search history.

(56) References Cited

U.S. PATENT DOCUMENTS

| | | | | |
|---|---|---|---|---|
| 3,908,676 | A * | 9/1975 | Levine et al. | 132/218 |
| 3,921,650 | A * | 11/1975 | Montgomery | 132/218 |
| 4,469,934 | A * | 9/1984 | Isshiki et al. | 219/222 |
| 4,662,385 | A * | 5/1987 | Schefer | 132/218 |
| 5,853,010 | A * | 12/1998 | Suh | 132/217 |
| 6,009,884 | A * | 1/2000 | Suh | 132/217 |
| 6,591,842 | B2 * | 7/2003 | Gueret | 132/218 |
| 6,616,366 | B1 * | 9/2003 | Weihrauch | 401/286 |
| 7,322,366 | B2 * | 1/2008 | Cho | 132/217 |
| 7,497,218 | B2 * | 3/2009 | Gueret | 132/217 |
| D591,955 | S * | 5/2009 | Kulik | D4/136 |
| 7,669,605 | B2 * | 3/2010 | Cho | 132/217 |
| 7,950,863 | B2 * | 5/2011 | Bouix et al. | 401/129 |
| 2002/0023657 | A1 * | 2/2002 | Gueret | 132/218 |
| 2005/0150509 | A1 * | 7/2005 | Gueret | 132/217 |
| 2007/0062551 | A1 * | 3/2007 | De Brouwer et al. | 132/218 |
| 2007/0186947 | A1 * | 8/2007 | Cho | 132/217 |
| 2008/0105655 | A1 * | 5/2008 | Cho | 219/50 |
| 2008/0216857 | A1 * | 9/2008 | Tranchant et al. | 132/218 |
| 2008/0245382 | A1 * | 10/2008 | Marciniak-Davoult et al. | 132/200 |
| 2009/0056735 | A1 * | 3/2009 | Suh | 132/217 |
| 2009/0114239 | A1 * | 5/2009 | Chen | 132/218 |
| 2009/0159094 | A1 * | 6/2009 | Dumler | 132/218 |
| 2010/0000566 | A1 * | 1/2010 | Wyatt et al. | 132/218 |
| 2010/0043817 | A1 * | 2/2010 | Haan | 132/211 |
| 2010/0054841 | A1 * | 3/2010 | Cho | 401/1 |
| 2010/0178095 | A1 * | 7/2010 | Bouix et al. | 401/1 |
| 2010/0212097 | A1 * | 8/2010 | Jeong et al. | 15/160 |
| 2011/0176852 | A1 * | 7/2011 | Ilekti et al. | 401/2 |
| 2011/0226276 | A1 * | 9/2011 | Limongi et al. | 132/218 |

* cited by examiner

*Primary Examiner* — Vanitha Elgart
(74) *Attorney, Agent, or Firm* — Maria Erlinda Co Sarno, Esq.

(57) ABSTRACT

An eyelash groomer having multiple functions on a function head portion of the groomer. The number of functions depend upon the number of function head pieces. Each function head pieces is recommended to have a plurality of small bridges protruding perpendicularly from its respective bases to cage a heating element accessible to each function head piece of the function head of the eyelash groomer. The bridges also prevent the skin from directly contacting the heating element but allow the eyelashes direct contact for optimum curling. The bridges also serve as a guide for the eyelashes because the eyelashes enter at the intervals or spaces between the bridges. The heating element run horizontally beneath each function head piece. A heating mechanism heats the heating element and a protection case houses the components of the heating mechanism and serves as a handle for the eyelash groomer.

16 Claims, 12 Drawing Sheets

FIG. 10
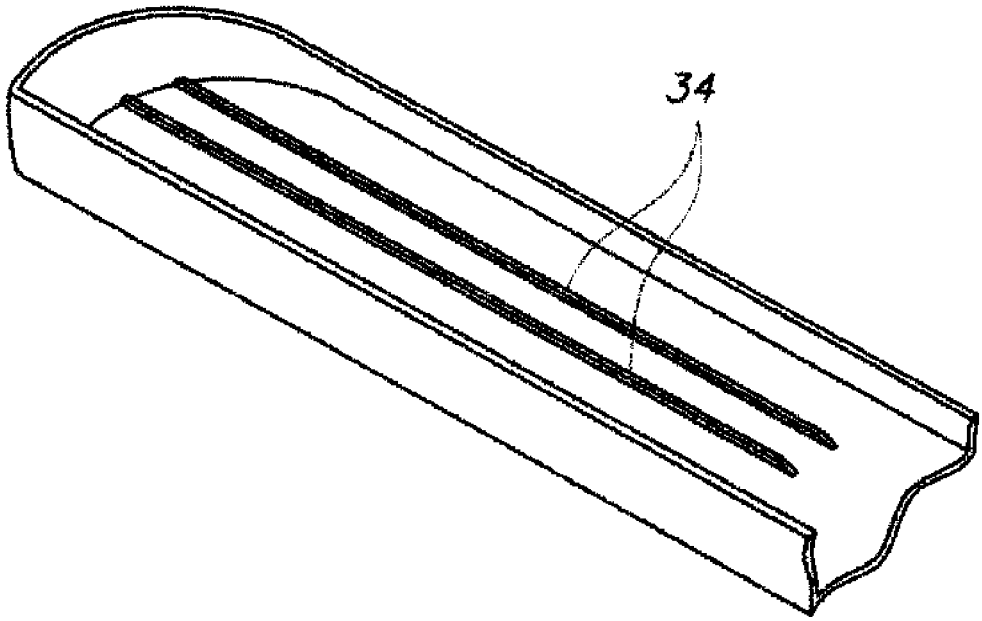
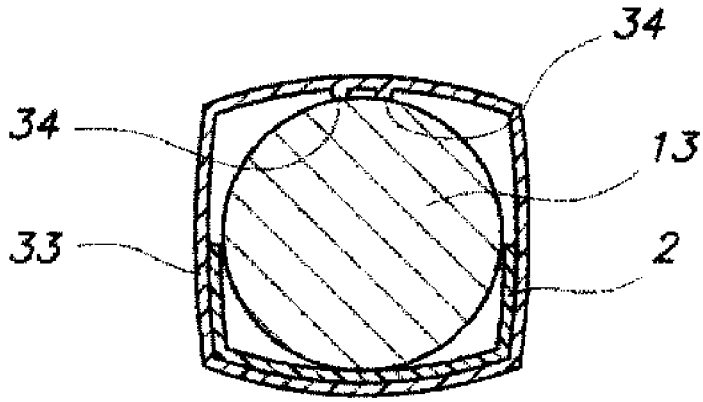
FIG. 10A

HEATED EYELASH GROOMER

This invention relates to a heated eyelash groomer having multiple functions in one device such as a curler and a comb sharing one common heating member on the function head of the heated eyelash groomer.

BACKGROUND

Most eyelash curler shape the eyelashes purely by mechanical pressure by inserting the eyelashes between two pinching elements, mostly arched to conform with the shape of the eyelids. This invention differs from the heated eyelash curlers since these have only one function such as one disclosed in U.S. Pat. No. 7,322,366 from the same inventor. This one functional heated eyelash curler incorporates a heating element into the function head to hasten the curling process as well as result into a longer lasting curl. The eyelashes are curled by a simultaneous application of heat and pressure. This eyelash curler has the following features of providing a stable heat; caging or surrounding the heating element by a protective shield to prevent the hands or skin from touching its surface; incorporating a pigmented silicone piece temperature indicator that directly contacts the heating element for fast and accurate response; heating to the desired temperature at optimum rate, and if desired, incorporating a light emitting diode (LED) as indicator to indicate heater status by turning on a red LED when the power switch is "on" and by subsequently turning on a green LED when the heater is at a proper eyelash curling temperature, optionally adopting a mechanism wherein the red and green LED rapidly turn on and off repeatedly when the power source is low such as when the charge of the battery is low. However, when one uses this heated eyelash curler, after curling the eyelashes, one still have to get hold of other devices for other functions such as an eyelash comb to even out the mascara, if applied on or to put fine finishing touches on the eyelashes It is therefore an object of this invention to provide an eyelash groomer capable of performing more than one function in one device.

It is also an object of this invention to provide an eyelash groomer having at least a curler and a comb on the function head of the device.

It is a further object of this invention to provide an eyelash groomer with only with one heating element that can heat all functions thereby keep the portability of the device as well as contain the cost.

BRIEF DESCRIPTION OF THE DRAWING

FIG. 10 is a view of a cut out portion showing railings on an interior side of a wall of a protection case.

FIG. 10A is a cross sectional view of the protection case taken along I-I of FIG. 9A showing two railings pressing on the battery.

SUMMARY OF THE INVENTION

Figure 1:
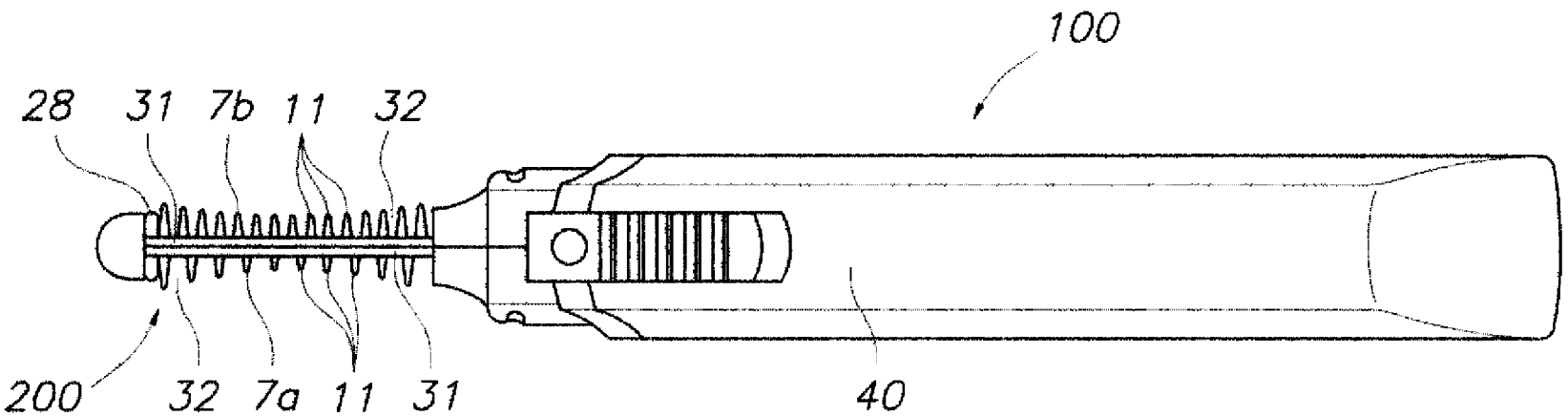
FIG. 1 is a perspective view of the heated eyelash groomer showing the function head with a curler and a comb.

An eyelash groomer having multiple functions on a function head portion of the groomer. The function head portion of the eyelash groomer is also simply referred to as function head. The number of functions depend upon the number of function head pieces. Each function head pieces is recommended to have a plurality of small bridges protruding perpendicularly from its respective bases to cage a heating element accessible to each function head piece at the function head of the eyelash groomer. The heating element run horizontally beneath each function head piece. A heating mechanism heats the heating element and a protection case houses the components of the heating mechanism and serves as a handle for the eyelash groomer.

The function head of the eyelash groomer can easily accommodate two function head pieces, one for curling an eyelash and one for combing an eyelash. The plurality of small bridges protruding perpendicularly from the base of the function head piece used for curling has a distance or space between adjacent small bridges longer than the distance or space between adjacent small bridges for combing. A switch connected to a switch knob is used here for easily turning the heating mechanism 'on' or 'off'. A silicone piece may be placed on the function head for detecting the temperature of the heating element on the eyelash groomer.

The eyelash groomer shown here in detail as example has the two functions, one for curling and one for combing and has the plurality of bridges as described above as well as the switch knob and the silicone piece. It comprises an upper casing having a first function head piece on one end and a first rear piece opposite the first function head piece; a lower casing having a second function head piece on one end and a second rear piece opposite the second function head piece; the second rear piece longer than the first rear piece to leave a portion open for accommodating a power source; a hollow middle compartment formed after the upper casing attaches to the lower casing, the middle compartment housing components of a heating mechanism for heating a heating element running horizontally beneath each function head pieces accessible to all function head pieces; a plurality of small bridges protruding perpendicularly from a base of the first and second function head pieces caging the heating element; a protection case housing the components of the heating mechanism fitting over the rear pieces of the upper and lower casings and serving as a handle for the eyelash groomer; and, a switch connected to a switch knob for easily turning the heating mechanism 'on' or 'off'. The plurality of bridges protruding from the first and second function head pieces are recommended to be arranged and sized to have an arcuate top surface. An indicator lamp that lights up when the heating is 'on' can be incorporated into the eyelash groomer for easy detection. Depending upon the location of the lamp relative to the switch knob, the switch knob can have an opening situating in front of a reflector displaying an indicator lamp when the heating is 'on', and retracting from the reflector when the heating is turned 'off'. The protection case have at least one railing on an interior wall facing the power source to hold the power source in place when the protection case is fitted over the rear end pieces of the upper and lower casing and includes an etched out opening to accommodate the switch knob located on an outside surface of the rear pieces of the upper and lower casings as the switch knob moves forward when the switch connected to the switch knob is turned 'on' and retracts back as the switch on the switch knob is turned 'off'. A cap can be used to cover the function head of the eyelash groomer. The cap inserts into the function head with its internal walls snugly fitting into the recessed neck of the eyelash groomer. The outside surface of the cap for aesthetic reason is recommended to align with the outside surface of the protection case.

DETAILED DESCRIPTION OF THE INVENTION

Figure 2:
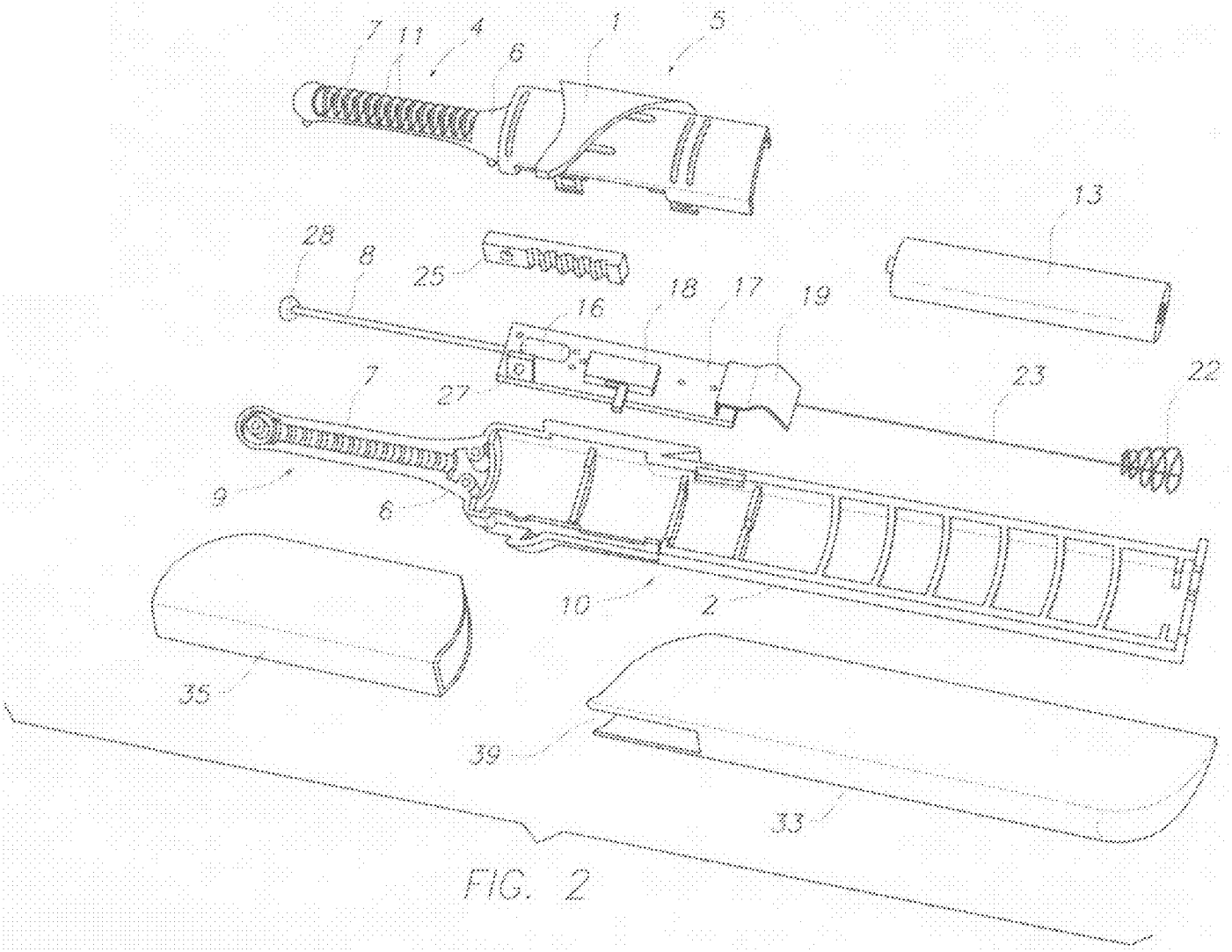
FIG. 2 is an exploded view showing the parts making up the eyelash groomer of FIG. 1.

FIG. 1 shows a perspective view of an example of a heated eyelash groomer 100 having a double function on its function head 200. Depending upon the size and shape of the function head, one can incorporate more than two functions by adding additional function head pieces. FIG. 2 shows the parts of the example shown in FIG. 1 prior to assembly. The eyelash groomer shown on FIGS. 1, 2 and 3 basically has three major parts, an upper casing 1, a lower casing 2 and a middle hollow compartment 3 containing components of the heating mechanism. The heating mechanism includes all the components needed to heat the eyelash groomer. Most of the components reside inside the middle compartment formed after the upper casing 1 and the lower casing 2 are attached together.

The upper casing includes a first function head piece 4 and a first rear piece 5 with a recessed neck 6 leading to the first function head piece 4 as shown in FIG. 2. The first rear piece 5 of the upper casing is shorter than that of the lower casing 2. The lower casing, likewise, includes a second function head piece 9 and a second rear piece 10 with a recessed neck 6 leading to the second function head piece 9 as shown in FIG. 2. The second rear piece 10 is longer than the first rear piece to leave a portion of the second rear piece open for accommodating a power source. The head pieces 4 and 9 usually have an arcuate top surface 7 shaped to cause an upward curl or comb after several repeated strokes of the eyelashes on a heating element 8 running horizontally beneath each of the head pieces as will be described more fully below. The parts herein are labeled identically if they are constructed the same. The plurality of small bridges 11 from the first and second function head pieces are arranged and sized to have the arcuate top surface. The plurality of small bridges 11 run perpendicular, that is protrude, from the bases of the first and second function head pieces. The number of bridges to cause an upward curl on the eyelashes is usually less than those used for combing. The number of bridges depend upon the length of the function head. For example, a length of approximately 2.5 cm. will have around 10 bridges for curling while those for combing the eyelashes will have around 15 bridges. The bridges used for curling is identified as 7*a* and those for combing is 7*b*. The curling bridges can be on the first head piece while the combing bridges can be on the second headpiece or vice-versa. The distance or space between adjacent bridges for curling is more, that is longer, than those for combing. For example, the distance between adjacent bridges for curling can be 2.3 mm+/−0.2 mm while those for combing can be 1.5 mm+/−0.15 mm.

Figure 3:
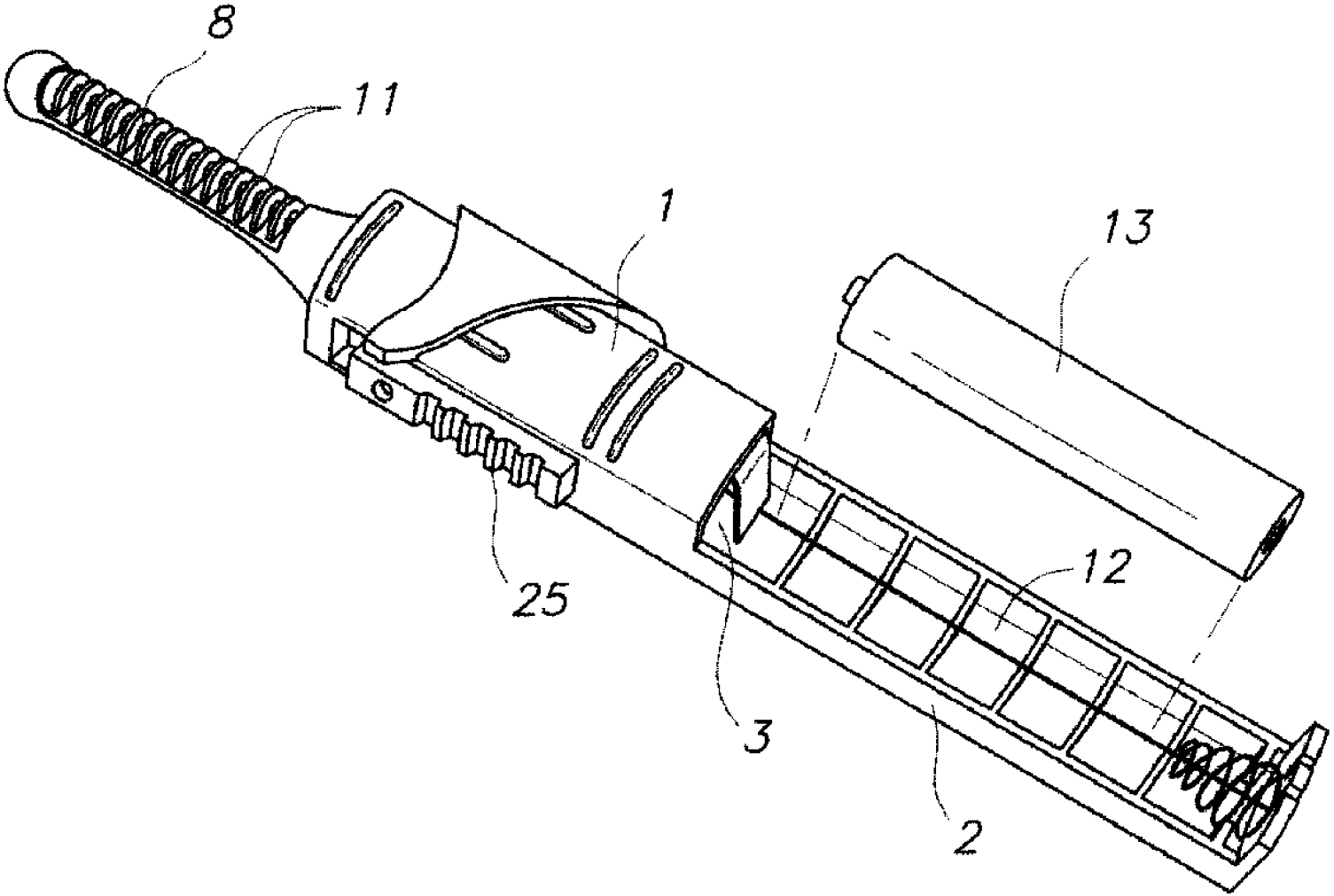
FIG. 3 is a perspective view showing the upper casing attached to the lower casing leaving an open tail portion of the lower casing.
Figure 4:
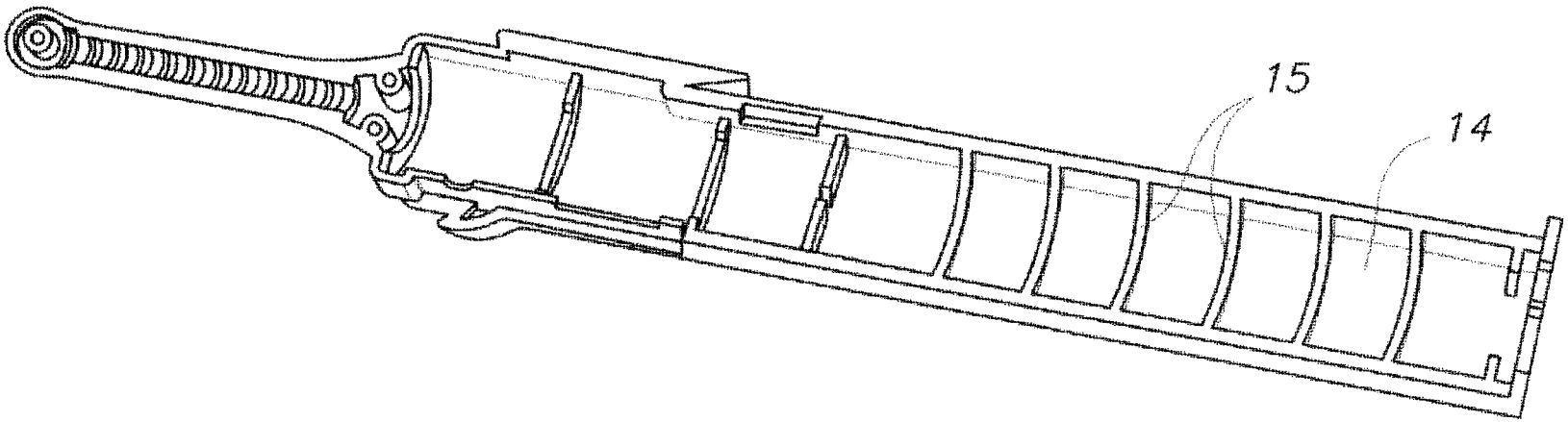
FIG. 4 is a plan view showing the interior wall of the lower casing having solid strips protruding perpendicularly to support the components of the heating mechanism.

The lower casing 2 is designed to match and attach to the upper casing 1, forming a hollow middle compartment 3 enclosed by the function head pieces, neck and portions of the rear pieces extending through the length of the first rear piece 5 of the upper casing 1. Since the second rear piece 10 of the lower casing is longer, an open tail portion 12 of the lower casing is used to accommodate a power source 13, here a battery, as shown in FIG. 3. FIG. 4 shows the interior wall 14 of the lower casing having solid strips 15 protruding perpendicularly to support the components of the heating mechanism. The open tail portion 12 of the lower casing 2 can be covered by means known in the art. One way is to have a protection case that completely envelopes the rear pieces 5 and 10 and the exposed tail portion 12 while another means just covers the exposed tail portion 12 of the lower casing.

Figure 3A:
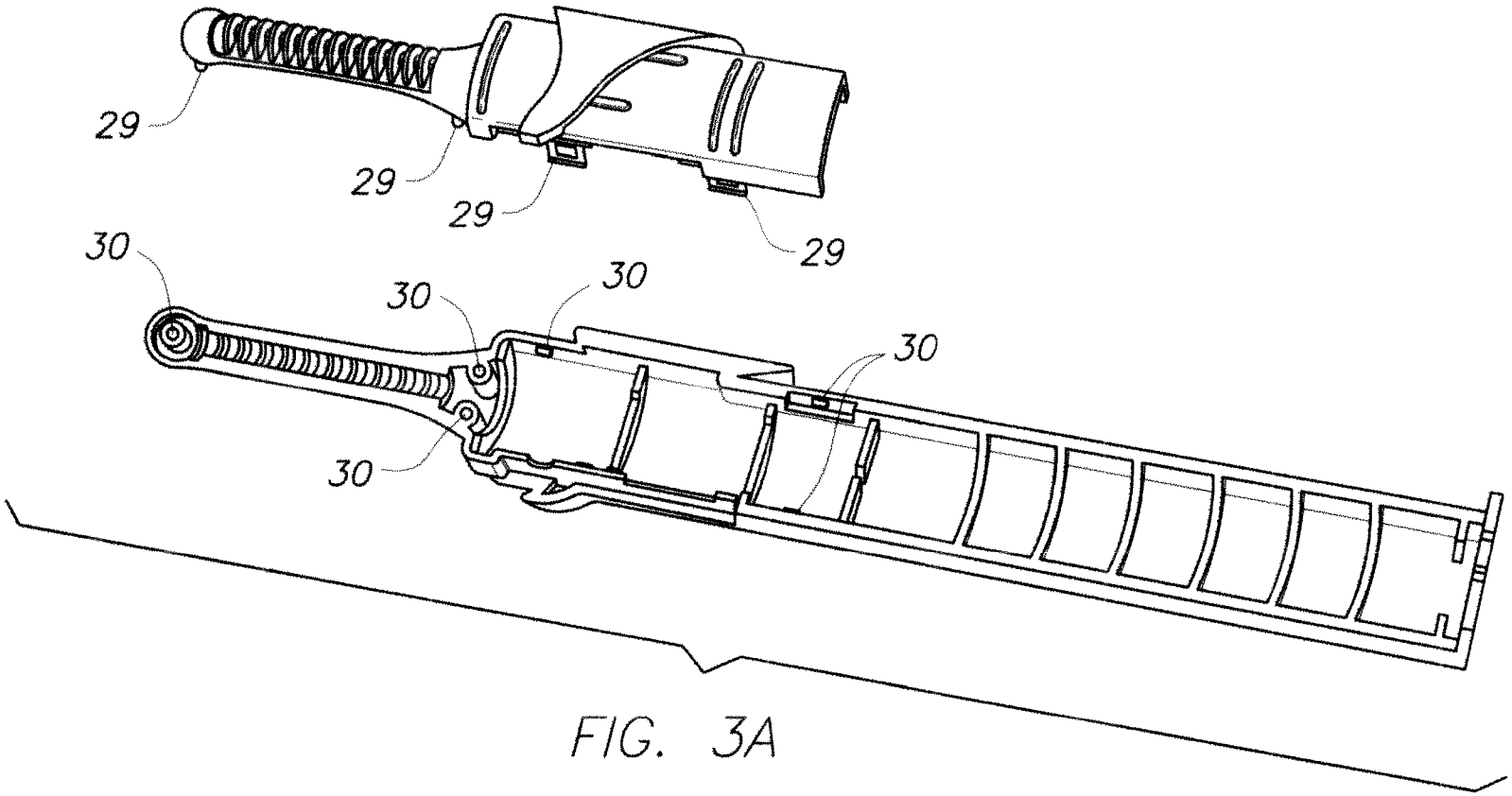
FIG. 3A is a perspective view showing bosses or protrusions on one casing and matching holes or openings on the other casing to enable snapping the two casings together.
Figure 5:
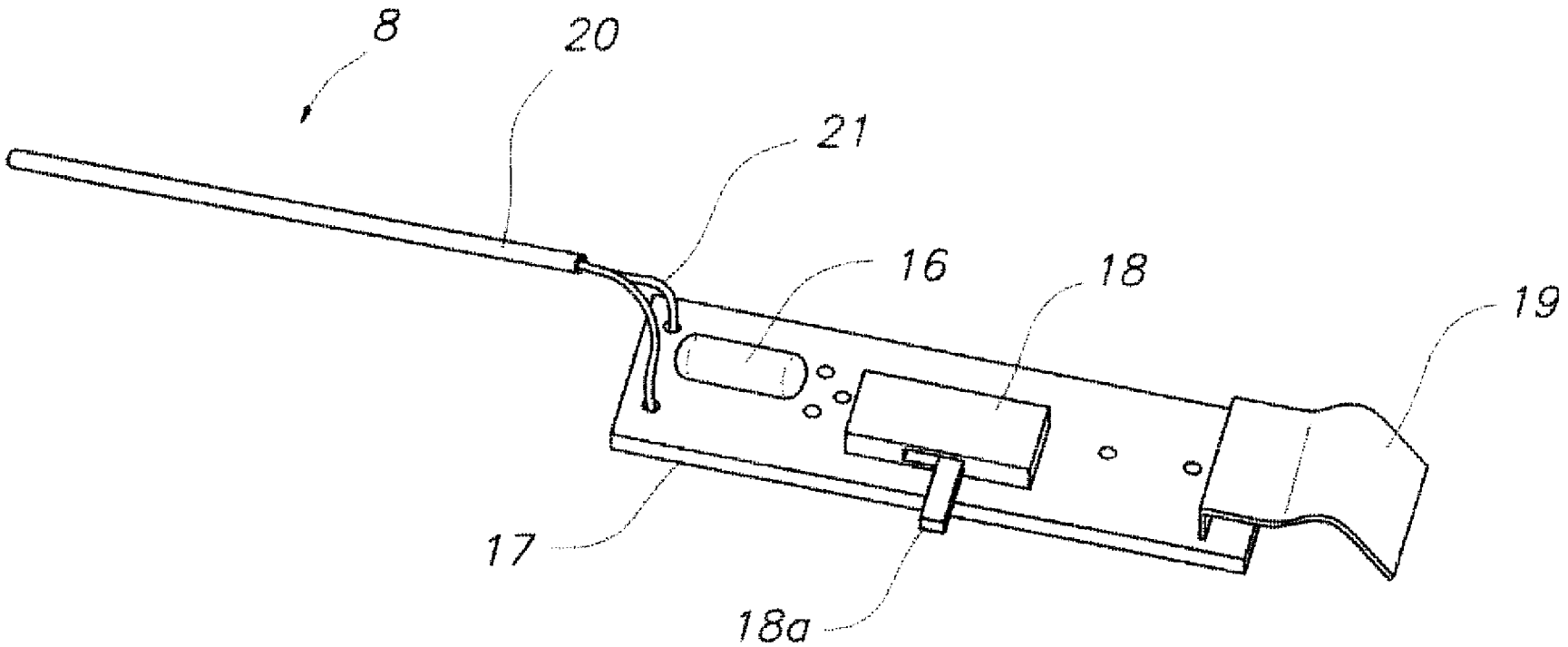
FIG. 5 is a perspective view showing how the heating element attaches to the printed circuit board (PCB).
Figure 6:
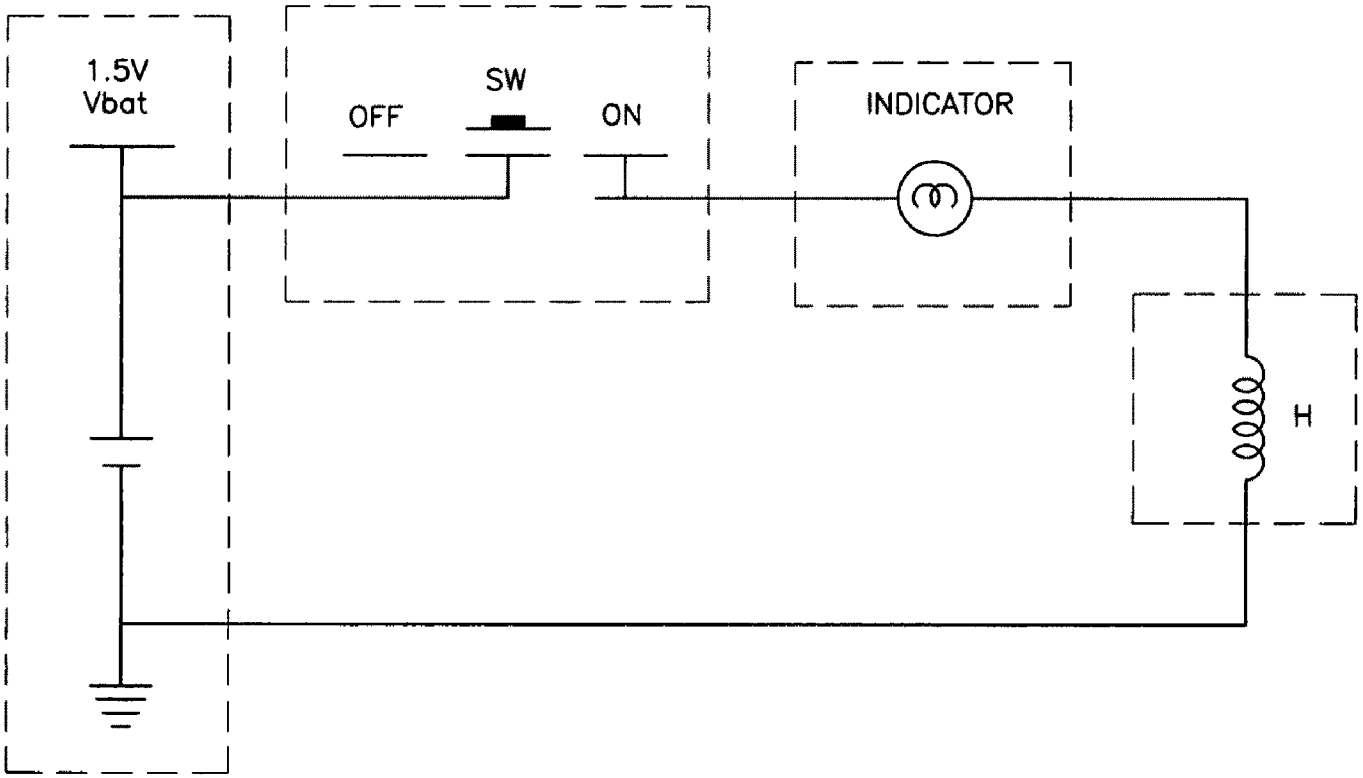
FIG. 6 is a circuit diagram of the heating mechanism.
Figure 7A:
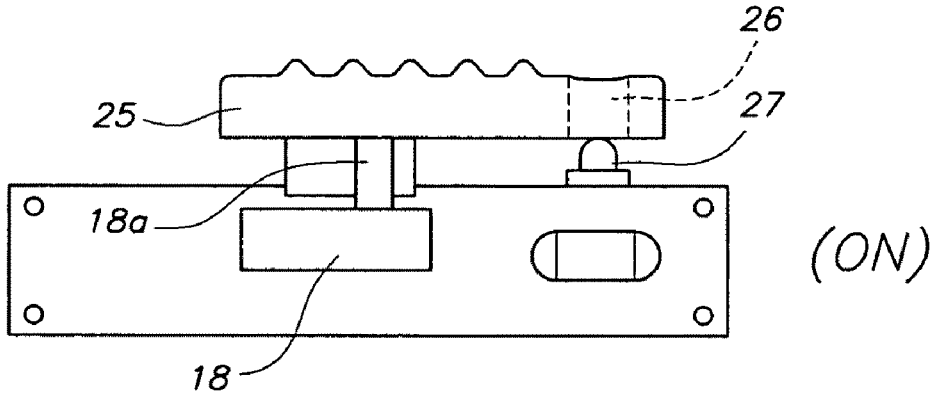
FIG. 7A is a schematic view showing a switch knob connected to a switch in the "on" position.
Figure 7B:
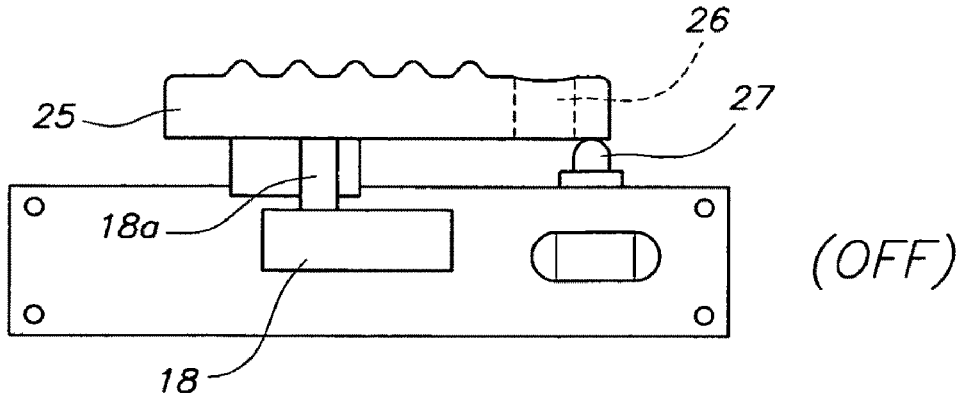
FIG. 7B is a schematic view showing a switch knob connected to a switch in the "off" position.
Figure 8:
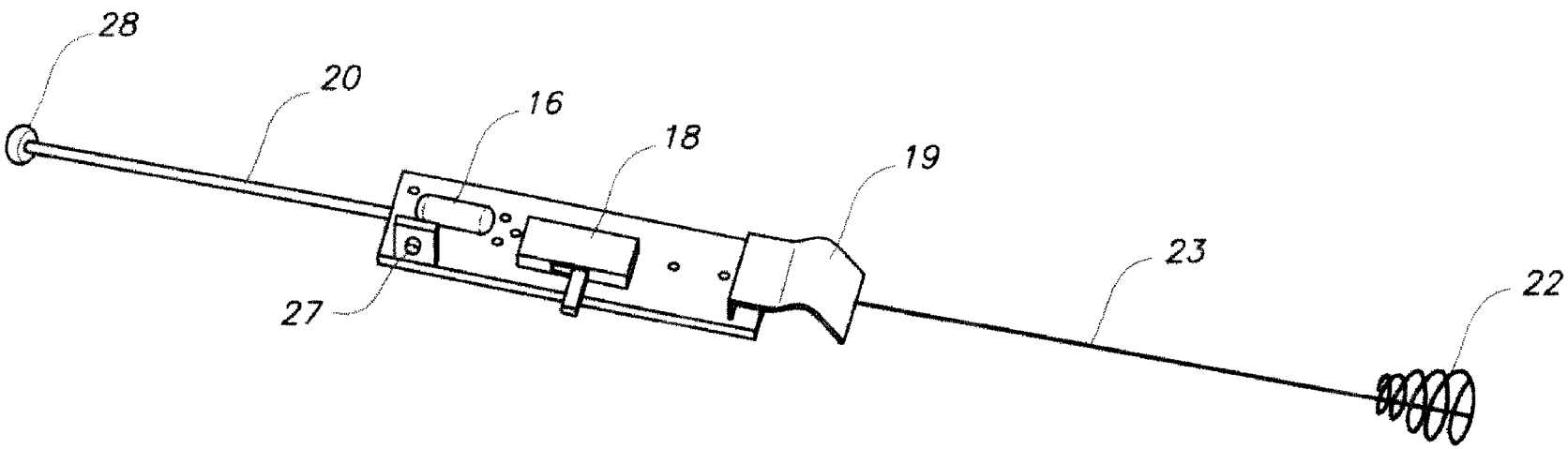
FIG. 8 is a plan view of the assembled heating mechanism
Figure 8A:
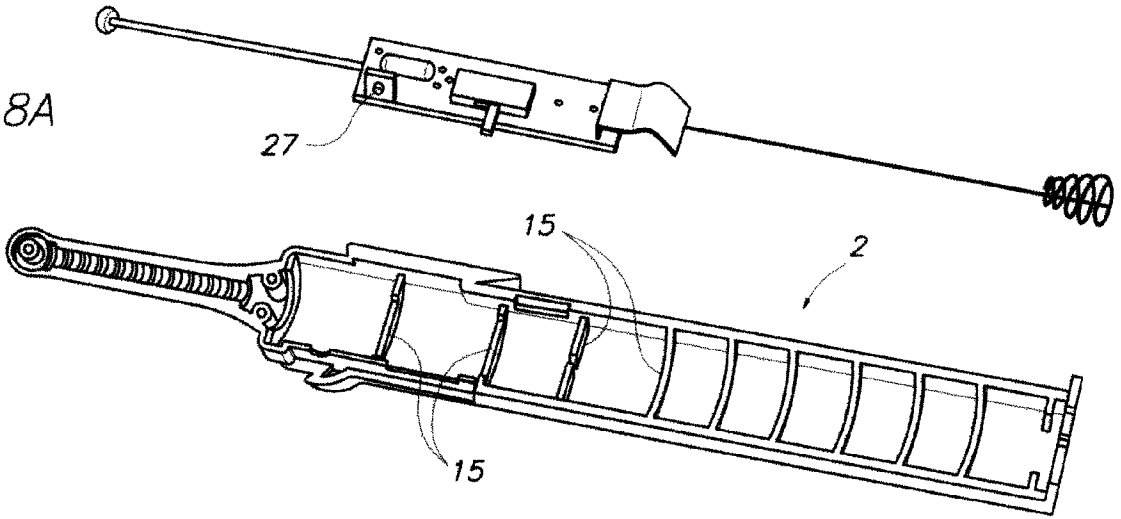
FIG. 8A shows the heating mechanism detached from the lower casing.
Figure 8B:
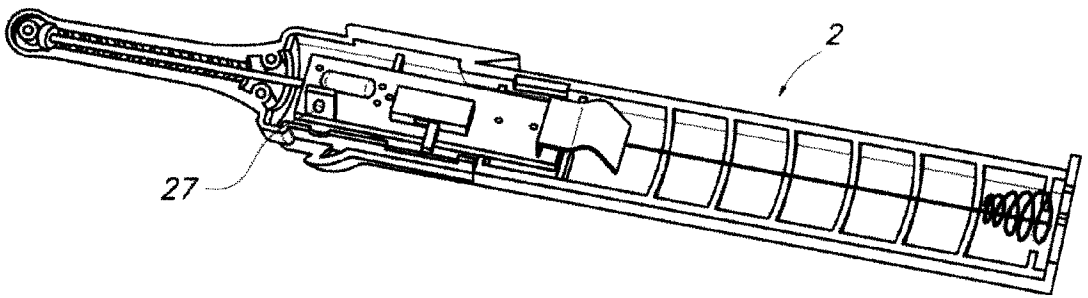
FIG. 8B shows the assembled heating mechanism laying on the solid strips protruding perpendicularly from the lower casing.

Assembly of the components of an example heating mechanism including an indicator lamp is described as follows. The lamp 16 lights up when the heating is 'on'. The lamp is inserted into a Printed Circuit Board (PCB) 17 together with the switch 18 and the positive (+) terminal 19. These are soldered to the PCB for permanency after attachment. The PCB contains the electrical connections for the switch. The electrical connections between the switch, the heating element and the power source is shown in FIG. 6. The heating element 8 which includes a brass tube 20 containing the heating wires 21 is attached to the PCB 17 at an end proximal to the lamp 16 in a manner shown in FIG. 5. The heating element disclosed in U.S. Pat. No. 7,322,366 can be used instead of the heating element described here. The negative (−) terminal 22 is connected to the PCB at the end opposite the heating element. Between the positive 19 and the negative 22 terminals is a connecting wire 23 to connect the charged terminals. The PCB may have a flat or a curved surface. Both heating element and the negative terminal are also soldered for permanent attachment to the PCB. When a battery 13 is used as the power source, it is situated between the positive and the negative terminal. Heating by the mechanism described above commences when the switch is turned to the "on" position to close the circuit as shown in FIG. 6 and terminated when the switch is turned to the "off" position. Turning the switch "on" or "off" is facilitated by a switch knob 25 which is connected to the switch as shown in FIGS. 7A and 7B. A protruding piece of the switch 18*a* inserts into a matching slot at the switch knob such that the switch moves along in the same direction as the movement of the switch knob. The switch knob 25 here has an opening 26 on one end which situates on top of a reflector 27 when the switch is "on", that is when the device is being heated, displaying the lit indicator lamp 16 as shown in FIG. 7A and retracts from the reflector when the device is turned "off" or not being heated as shown in FIG. 7B. As shown in FIG. 1, the switch knob is on a lateral side of the eyelash groomer 100. Since the PCB lies horizontally on top of the solid strips 15, the reflector 27 enables the light from the lamp 16 to be seen through the opening 26 of the switch knob as shown in FIG. 8B. Near the tip of the brass tube 20 is introduced a silicone piece 28, preferably shaped like a ring for easy introduction into and around the brass tube. Direct contact between the silicone piece and the brass tube containing the heating wires provides a more reliable method for detecting the temperature of the heating element because the silicone piece contains a pigment that changes its color with temperature. The pigmented silicone material used here can be purchased from Zhejiang Xinan Chemical Industrial Group Co., Ltd. having a website: www.xinanchem.com. At room temperature, the color of the chosen pigmented silicon piece is purple. The purple color gradually changes to opaque white or colorless as the temperature of the heating element rises. When the heating element is at the desired temperature, for example between 60-70 degrees Centigrade, the color of the chosen pigmented silicone piece is opaque white or colorless. The user is notified that the eyelash groomer is heated when the silicone piece has lost its purple color. The assembled heating mechanism, the heating element together with the terminals for the power source without the power source is shown in FIG. 8. FIG. 8A shows the heating mechanism detached from the lower casing while FIG. 8B shows the assembled heating mechanism laying on the solid strips 15 protruding perpendicularly from the lower casing 2. After placement of the heating mechanism, the upper casing is usually snapped for ease of assembly into the lower casing to cover portions of the heating mechanism as shown in FIG. 3. Snapping together of the two parts/casings is generally brought about by bosses or protrusions 29 at one part/casing connecting to matching holes or openings 30 located on the other part/casing as shown in FIG. 3A. While the example shown here have two casings snapping together to form the middle compartment, it is possible to mold the entire upper casing and lower casing in one piece and just insert the heating mechanism into the interior hollow compartment. The switch knob 25 situates outside of the walls of the upper and lower casing after these two casings are assembled together as shown in FIGS. 1 and 3 and free to move upwards to turn the switch to the 'on' position and downwards to turn the switch in the 'off' position. The heating mechanism and temperature control illustrated above is simplified compared to that disclosed in U.S. Pat. No. 7,322,366 ('366) because the main inventive feature is the presence of more than one function in a single device. It is understood that other heating mechanisms such as that disclosed in '366 can be employed for this device.

The other important feature of the eyelash groomer 100 is the ability to heat all function head pieces with a single heating element. The example shown here has two function head pieces. The heating element is situated on the hollow middle compartment 3 caged underneath the bridges 11 which protrude from the base 31 of the function head having both function head pieces 4 and 9 of the lower and upper casings, making it accessible to the function head pieces of the function head 200. The bridges prevent the skin from directly contacting the heating element 8 but allow the eyelashes direct contact for optimum curling. The bridges 11 also serve as a guide for the eyelashes because the eyelashes enter at the intervals or spaces 32 between the adjacent bridges. Here, the other function described is to comb the eyelashes which at the present time is done separately with an independent comb and consequently, at room temperature. With this device, even the combing can be done in a heated environment which will keep the curls better while removing excess mascara, if used, from the curled eyelashes. As in '366, the bridges can have vertically protruding blunt or round ended comblike spikes line horizontally along the ends of the bridges for added protection from burns and to assist in guiding the eyelashes. These comblike projections may also substitute for the bridges.

Figure 9:
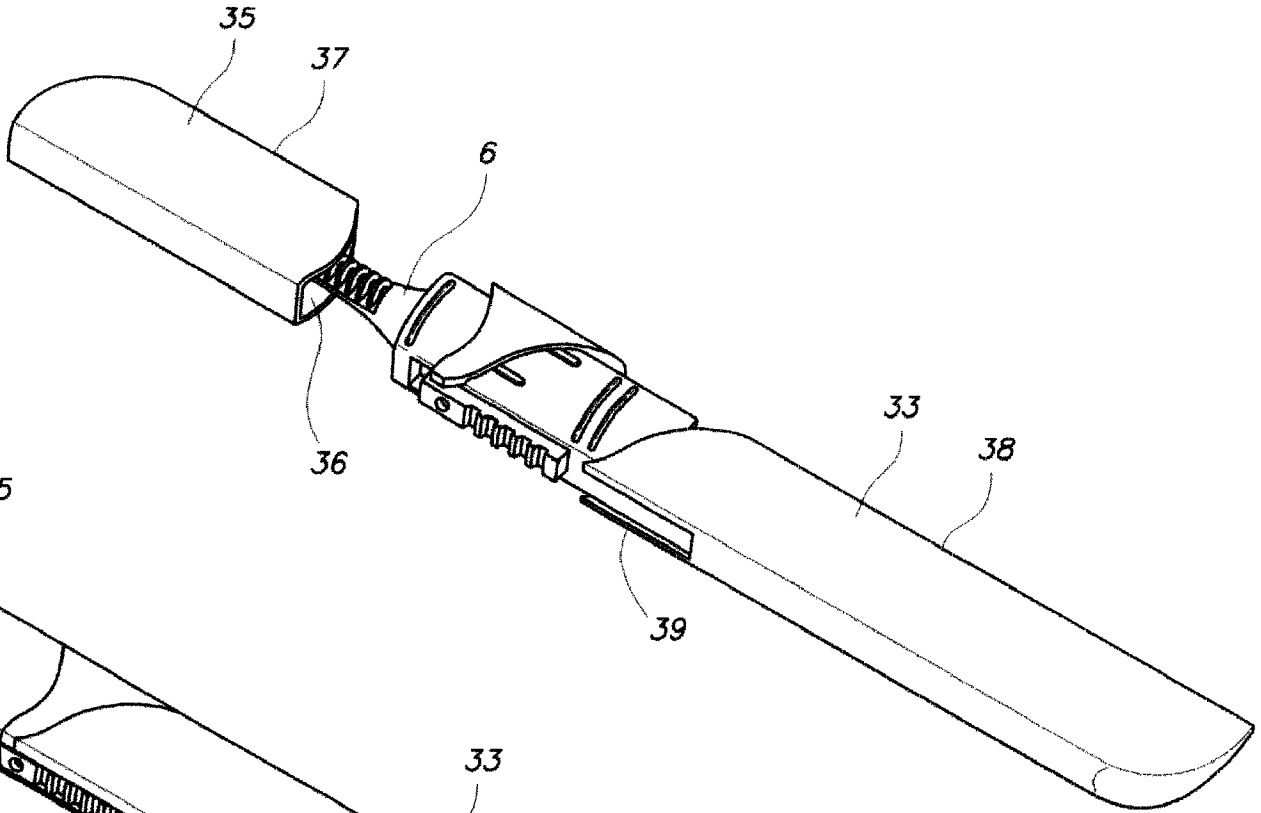
FIG. 9 is a perspective view of a protection case partially inserted and partially covering the rear pieces of the upper and lower casing.
Figure 9A:
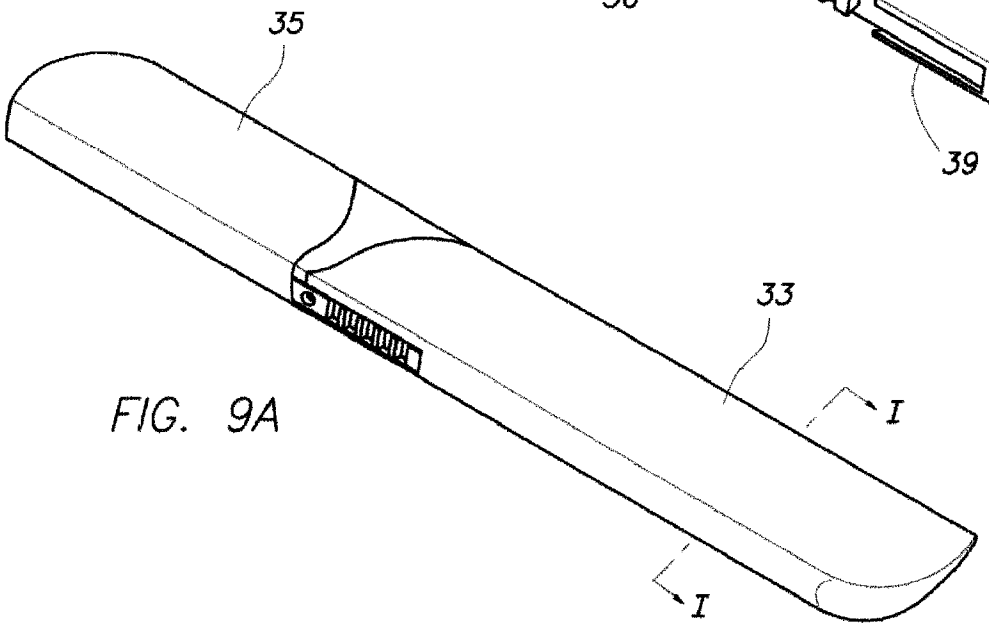
FIG. 9A is a perspective view of a protection case completely covering the rear pieces of the upper and lower casing including the open exposed tail portion of the lower casing.

An example of a protection case 33 that fits over and envelopes the rear pieces 5 and 10 which includes the open exposed tail portion 12 of the lower casing 2 is shown on FIGS. 9 and 9A. The protection case while shown here with a design, can simply be a cylindrical piece with straight edges with one end open for insertion into the assembled or molded casings and the other end closed. FIG. 9 shows the protection case partially inserted and partially covering the rear pieces while FIG. 9A shows the protection case enveloping the rear pieces. The protection case 33 serves as the housing for the components of the heating mechanism involved with heating element 8 as well as the handle for the groomer. At the interior wall of the protection case facing the exposed battery 13 are two protruding railings 34 to hold the power source, like a battery, firmly in place when the protection case is fitted over the rear pieces of the upper and lower casings as shown on FIGS. 10 and 10A. The protection case 33 has an etched out opening 39 to accommodate the switch knob 25 on the top surface 40 of the attached or molded rear pieces of the upper and lower casings as it moves forward when the switch is turned 'on' and retracts back as the switch is turned 'off'. A cap 35 is preferably but not necessarily used to cover the function head of the eyelash groomer as shown in FIGS. 9 and 9A. The cap 35 inserts with its internal walls 36 snugly fitting into the recessed neck 6 and/or portions of the rear pieces of the eyelash groomer and the outside surface 37 of the cap aligning with the outside surface 38 of the protection case 33. The casings, protection case and cap may be made of plastic such as acrylonitrile butadiene styrene and equivalents or of nonconducting metals such as aluminum.

To use the groomer either to curl or comb, one simply let the eyelashes enter the spaces 32 between the bridges 11 until the eyelashes touches on the heating element 8 unlike the conventional curlers which require the eyelashes to situate between two pinching or forming elements, requiring manual dexterity and experience. The eyelashes curl after a few repeated upward strokes against the heating element 8. Combing with heat keeps the curl on the eyelashes better.

While the embodiments of the present invention have been described, it should be understood that various changes, adaptations, and modifications may be made therein without departing from the spirit of the invention and the scope of the claims.

I claim:

1. An eyelash groomer having multiple functions, comprising:

a function head having multiple function head pieces, each function head piece having a plurality of small bridges protruding perpendicularly from a base of the function head;

a heating element accessible to each function head piece of the function head of the eyelash groomer, the heating element running horizontally beneath each function head piece caged by the plurality of small bridges protruding from the base of the function head;

a heating mechanism having components for heating the heating element; and, a protection case housing the components of the heating mechanism and serving as a handle for the eyelash groomer.

2. The eyelash groomer of claim 1 wherein the function head has two function head pieces, one for curling an eyelash and one for combing an eyelash.

3. The eyelash groomer of claim 2 wherein the small bridges of the curling function head piece have a distance between adjacent small bridges longer than the distance between adjacent small bridges of the combing function head piece.

4. The eyelash groomer of claim 1 further comprising a switch connected to a switch knob for turning the heating mechanism 'on' or 'off'.

5. The eyelash groomer of claim 1 further comprising a silicone piece for detecting the temperature of the heating element on the eyelash groomer.

6. A heated eyelash groomer having two functions, comprising:

a function head having a function head piece for curling an eyelash and another function head piece for combing an eyelash, each function head piece having a plurality of small bridges protruding perpendicularly from a base of the function head, the small bridges of the curling function head piece having a distance between adjacent small bridges longer than the distance between adjacent small bridges of the combing function head piece;

a heating element accessible to each function head piece of the function head of the eyelash groomer, the heating element running horizontally beneath each function head piece caged by the plurality of small bridges protruding from the base of the function head;

a protection case housing components of a heating mechanism for heating the heating element and serving as a handle for the eyelash groomer; and, a switch knob connected to a switch for turning 'on' and turning 'off' the heating of the heating element on the heating mechanism having an opening situating in front of a reflector displaying an indicator lamp when the heating is 'on', the switch knob retracting the opening from the reflector when the heating is turned 'off'.

7. An eyelash groomer having multiple functions on a function head, comprising, an uppercasing having a first function head piece on one end and a first rear piece opposite the first function head piece;

a lower casing having a second function head piece on one end and a second rear piece opposite the second function head piece; the second rear piece longer than the first rear piece to leave a portion open for accommodating a power source;

a hollow middle compartment formed after the upper casing attaches to the lower casing, the middle compartment housing components of a heating mechanism for heating a heating element running horizontally beneath each function head pieces accessible to all function head pieces;

a plurality of small bridges protruding perpendicularly from a base of the function head having the first and second function head pieces caging the heating element said first function head piece having the plurality of small bridges with a distance between adjacent small bridges different from the distance between adjacent small bridges of said second function head piece;

a protection case housing the components of the heating mechanism fitting over the rear pieces of the upper and lower casings and serving as a handle for the eyelash groomer; and, means for turning 'on' and turning 'off' the heating of the heating element.

8. The eyelash groomer of claim 7 wherein the plurality of bridges from the first and second function head pieces are arranged and sized to have an arcuate top surface.

9. The eyelash groomer of claim 7 further comprising an indicator lamp on the heating mechanism that lights up when the heating is 'on'.

10. The eyelash groomer of claim 7 further comprising a switch knob connected to a switch on the heating mechanism having an opening situating in front of a reflector displaying an indicator lamp when the heating is 'on', the switch knob retracting the opening from the reflector when the heating is turned 'off'.

11. The eyelash groomer of claim 7 further comprising a silicone piece for detecting the temperature of the heating element on the eyelash groomer.

12. The eyelash groomer of claim 7 wherein one function head piece is for curling an eyelash and the other head piece is for combing an eyelash, the plurality of bridges for curling the eyelash having a distance between adjacent bridges longer than the distance between adjacent bridges for combing an eyelash.

13. The eyelash groomer of claim 12 wherein the distance between adjacent bridges for curling is 2.3 mm+/−0.2 mm while those for combing is 1.5 mm+/−0.15 mm.

14. The eyelash groomer of claim 7 wherein the protection case has at least one railing on an interior wall facing the power source to hold the power source in place when the protection case is fitted over the rear end pieces of the upper and lower casing.

15. The eyelash groomer of claim 7 wherein the protection case includes an etched out opening to accommodate a switch knob on an outside surface of the rear pieces of the upper and lower casings as the switch knob moves forward when a switch connected to the switch knob is turned 'on' and retracts back as the switch on the switch knob is turned 'off'.

16. The eyelash groomer of claim 7 further comprising a cap to cover the function head of the eyelash groomer.

* * * * *